United States Patent [19]

Shimizu et al.

[11] Patent Number: 4,579,608

[45] Date of Patent: Apr. 1, 1986

[54] GRAIN-ORIENTED SILICON STEEL SHEETS HAVING A VERY LOW IRON LOSS AND METHODS FOR PRODUCING THE SAME

[75] Inventors: Yoh Shimizu; Hiroshi Shishido; Yo Ito, all of Chiba; Hiroshi Shimanaka, Funabashi, all of Japan

[73] Assignee: Kawasaki Steel Corporation, Kobe, Japan

[21] Appl. No.: 557,383

[22] Filed: Dec. 1, 1983

Related U.S. Application Data

[63] Continuation of Ser. No. 296,168, Aug. 25, 1981, abandoned.

[30] Foreign Application Priority Data

Aug. 27, 1980 [JP] Japan ..... 55-116927

[51] Int. Cl.[4] ..... H01F 1/04

[52] U.S. Cl. ..... 148/111; 148/113; 148/31.5; 148/31.55

[58] Field of Search ..... 148/31.5, 31.55, 110, 148/113, 111

[56] References Cited

U.S. PATENT DOCUMENTS

| | | | |
|---|---|---|---|
| 3,105,782 | 10/1963 | Walter | 148/113 |
| 3,562,029 | 2/1971 | Goglio et al. | 148/31.55 |
| 3,764,406 | 10/1973 | Littmann | 148/110 |
| 4,108,694 | 8/1978 | Shiozaki et al. | 148/113 |
| 4,130,447 | 12/1978 | Marianeschi et al. | 148/31.55 |
| 4,160,708 | 7/1979 | Arendt et al. | 148/113 |
| 4,165,990 | 8/1979 | Reynolds et al. | 148/113 |
| 4,280,856 | 7/1981 | Inokuti et al. | 148/31.55 |

OTHER PUBLICATIONS

A Dictionary of Metallurgy, A. D. Merriman, 1958, p. 78.

*Primary Examiner*—John P. Sheehan

*Attorney, Agent, or Firm*—Balogh, Osann, Kramer, Dvorak, Genova & Traub

[57] ABSTRACT

Grain oriented silicon steel sheets having a very low iron loss $W_{17/50}$ of lower than 0.90 W/kg, in which Si content is 2–4%, are produced by containing at least one of Se and S in an amount of 0.010–0.035% and at least one of Sb, As, Bi and Sn in an amount of 0.010–0.080% as inhibitor, making a final gauge to be 0.15–0.25 mm, forsterite coating formed on the steel sheet surfaces in the final annealing to be 1–4 g/m$^2$ per one surface and a secondary crystallized grain size to be 1–6 mm.

9 Claims, 5 Drawing Figures

GRAIN-ORIENTED SILICON STEEL SHEETS HAVING A VERY LOW IRON LOSS AND METHODS FOR PRODUCING THE SAME

This application is a continuation of application Ser. No. 296,168, filed 8/25/81 now abandoned.

BACKGROUND OF THE INVENTION

The present invention relates to grain-oriented silicon steel sheets having an easy magnetization axis <100> in the rolling direction of the steel sheets and <110> on the sheet surface.

Grain-oriented silicon steel sheets have been mainly used for iron core of electric apparatus, such as converter and the like as soft magnetic materials and in particular, it has been recently strongly demanded to increase the properties of the electric apparatus and the like, to make the size of said apparatus small and to make the noise lower and the electric steel sheets having more improved magnetic properties have been demanded in view of energy saving.

The magnetic properties of steel sheets are generally evaluated by both iron loss property and magnetization property. The improvement of magnetizing property (represented by the magnetic induction $B_{10}$ value at a magnetizing force 1000 A/m) is particularly effective for increasing the designed magnetic induction and making the size of apparatus smaller. On the other hand, the improvement of the iron loss property (represented by iron loss $W_{17/50}$ per 1 kg when being magnetized to 1.7T (Wb/m$^2$) with 50 Hz) reduces the loss of heat energy when used as the electric apparatus and is effective in view of saving of consumed electric power. Since not only the magnetizing property but also the iron loss property can be improved by enhancing the orienting property of the products, that is by highly aligning the axis <100> of the crystal grains to the rolling direction, many investigations have been made particularly in this view and the products having $B_{10}$ of more than 1.90T have been produced.

As well known, the iron loss is roughly classified into hysteresis loss and eddy current loss. As the physical factors influencing upon these losses, there are the purity and inner strain of the material other than the above described crystal orientation with respect to the hysteresis loss and there are the electric resistance (for example Si amount), sheet thickness and magnetic zone size (crystal grain size) of the steel sheet and the tension applied on the steel sheet with respect the eddy current loss. In usual grain-oriented silicon steel sheets, the eddy current loss is more than $\frac{3}{4}$ of the total loss, so that it is more effective for reducing the total iron loss to reduce the eddy current loss than to reduce the hysteresis loss. Therefore, various attempts for reducing the eddy current loss have been made. As one of them, it has been proposed to increase Si content but when Si content is increased to 4.0%, the cold rolling ability is noticeably deteriorated, so that there is a limitation and such a means is not practical. As a means for applying tension on a steel sheet, a means utilizing a difference of thermal expansion coefficient between a base coating or a face coating and a base iron has been known but there is limitation in the tension obtained from the commercially utilized coating and there is also limitation in view of the uniformity, cohesion, appearance of the coating and the like and it is impossible to expect the satisfactory reduction of iron loss. It has been recently proposed to form scratches in perpendicular direction to the rolling direction on the surface of the produced sheet to make the magnetic zones fine whereby the eddy current loss is reduced. But, in this method, the effect may not be necessarily fully developed depending upon the shape, average crystal gain size and sheet thickness of the produced sheet and when a strain relief annealing is applied to the produced scratched sheet, the lowered iron loss is returned to the original unimproved value, so that this method is not practical.

SUMMARY OF THE INVENTION

The present invention aims to provide grain-oriented silicon steel sheets having a very low iron loss in which the above described defects possessed by the prior grain-oriented silicon steel sheets are obviated and improved, and methods for producing said silicon steel sheets.

The inventors have newly found that a very low iron loss can be obtained by combining a process for making crystal grain size of the produced silicon steel sheet fine without deteriorating the orientation and a process for making the sheet thickness thin by controlling the thickness of the forsterite coating formed on the steel sheet surface within an appropriate range and the present invention has been accomplished. That is, the present invention consists in grain-oriented silicon steel sheets having a very low iron loss of $W_{17/50}$ of lower than 0.90 W/kg, which must satisfy the following three requirements, that is, the sheet thickness being 0.15–0.25 mm, an average crystal grain size being 1–6 mm and an amount of forsterite coating formed on the sheet surface being 1–4 g/m$^2$ per one surface.

It has been known that when the sheet thickness of a grain-oriented silicon steel sheet is reduced by chemical polishing, mechanical polishing and other means, the eddy current loss is decreased. However, reversely the hysteresis loss is increased with the reduction of the sheet thickness. The increase of the hysteresis loss is slow when the sheet is relatively thick but as the sheet becomes thin, the hysteresis loss suddenly increases and the sheet thickness at which the total iron loss becomes lowest is 0.15–0.25 mm. But the product of $W_{17/50}$ of lower than 0.90 W/kg, which is the object of the present invention can not be obtained merely by reducing the sheet thickness. In particular, when the thin silicon steel sheet is produced through a usual production process wherein a cold rolling and an annealing are repeated and finally an annealing at a high temperature is applied to form forsterite coating on the surface, the orientation is somewhat deteriorated, so that it has been more difficult to obtain the very low iron loss of lower than 0.90 W/kg.

Concerning the relation of the grain size to the iron loss, it has been known that when the grain size of the sheet becomes smaller, the iron loss is generally reduced. For example, it is disclosed in J. Appl, Phys. 1967, 38, 1104, M. F. Littnau that the lowest value of the iron loss lies in a grain size of about 0.5 mm and when the sheet thickness is 0.1 mm, the lowest value of the iron loss is $W_{15/60}$ of 0.45 W/lb, which is calculated into $W_{17/50}$ of about 0.96 W/kg. However, even if the grain size is more reduced, the prior technic has not been able to produce the product having a low iron loss of $W_{17/50}$ of lower than 0.90 W/kg, which is the object of the present invention, because the orientation is deteriorated.

Concerning the relation of an amount of forsterite coating formed on the silicon steel sheet surface to the iron loss, there is no clear correlation in the prior product having the sheet thickness of more than 0.27 mm. However, when the sheet thickness is as thin as 0.15–0.25 mm, it is important to control this coating amount in an appropriate amount and said amount is 1–4 $g/m^2$ per one surface. When the sheet thickness is thin, if the forsterite coating is too thick, the weight of the forsterite coating in the total weight is increased and the iron loss is deteriorated and further when the amount of the coating is larger than 4 $g/m^2$, the smoothness of the coating and the base iron interface is deteriorated and the influence of the strain remaining near the interface becomes particularly larger and the iron loss is deteriorated. The lower limit of the forsterite amount of 1 $g/m^2$ is defined in order to maintain the insulation of the surface and the amount is necessary for obtaining the good face coating.

The inventors have accomplished the commerical production of grain-oriented silicon steel sheets having a low iron loss of $W_{17/50}$ of lower than 0.90 W/kg by making the sheet thickness as thin as 0.15–0.25 mm, controlling the secondary grain size to be 1–6 mm without deteriorating the orientation and controlling the weight of the forsterite coating on the steel sheet surface per one surface to be 1–4 $g/m^2$.

FIG. 1 shows the relation of the thickness of grain-oriented silicon steel sheets containing 3.10% of Si and having various average secondary grain sizes to the iron loss of $W_{17/50}$. Any produced sheet has forsterite coating of 2–3 $g/m^2$ per one surface on the surface and the magnetic conduction $B_{10}$ is 1.89–1.93T. The sheet thickness showing the lowest value more or less varies depending upon the average crystal grain size of the produced sheet and these sheets show the iron loss of $W_{17/50}$ of lower than 0.90 W/kg within a range of 1–6 mm of average grain size.

FIG. 2 shows the relation of an amount of forsterite on the grain-oriented silicon steel sheets containing 3.02% of Si to the iron loss with respect to the sheets having various thicknesses. It can be seen that when the sheet thickness is thin, the forsterite weight per one surface must be 1–4 $g/m^2$ in view of obtaining the low iron loss.

Then, explanation will be made with respect to a method for producing grain-oriented silicon steel sheets having a low iron loss and the producing conditions.

As the component elements fine precipitation dispersing phase which is called as inhibitors which restrain the growth of the inconvenient crystal grain in the final annealing step at high temperatures and promote the secondary recrystallization in Goss orientation, for example MnS, MnSe, AlN, BN and VN, and Sb, As, Bi, Sn etc. which are known as grain boundary segregation type elements, are included. It is possible to produce grain-oriented silicon steel sheets having a very low iron loss of $W_{17/50}$ of lower than 0.90 W/kg by using a silicon steel raw material containing the necessary amount of at least one of the above described compounds or elements and controlling the sheet thickness and the secondary grain size within the range of the present invention. But, the level of low iron loss capable of being reached and the reduction rate range and annealing condition accepted for obtaining these levels are not necessarily same depending upon the kind, amount and combination of the inhibitors.

50 kg of vacuum melted steel ingots (Si: 2.90–3.35%, C: 0.030–0.048%, Mn: 0.045–0.080%) having various inhibitor compositions were subjected to 2 cold rolling steps to produce steel sheets having a thickness of 0.15–0.25 mm. In this case, in order to examine the conditions in steps for obtaining the products satisfying the requirements of the present invention, the reduction rate in the final cold rolling was varied within a range of 55–85% and the temperature raising rate in the decarburizing annealing was varied and the production step was varied in ten kinds with respect to a raw material of the same composition, whereby the stability of the properties was compared. The obtained results are shown in the following Table 1.

TABLE 1

| Inhibitor component | | | Average Grain size (mm) | Lowest iron loss $W_{17/50}$(w/kg) | Average iron loss $W_{17/50}$(w/kg) | Passing ratio (%) $W_{17/50}$(0.90 w/kg) |
|---|---|---|---|---|---|---|
| MnSe | Se: 0.025 | | 4.5–9.8 | 0.89 | 0.965 | 10 |
| MnSe + Sb | Se: 0.040 | Sb: 0.030 | 0.9–11.4 | 0.98 | 1.091 | 0 |
| MnSe + Sb | Se: 0.020 | Sb: 0.035 | 2.8–5.8 | 0.83 | 0.862 | 90 |
| MnS + Sb | S: 0.030 | Sb: 0.038 | 2.0–6.6 | 0.86 | 0.881 | 70 |
| MnSe + Bi | Se: 0.022 | Bi: 0.020 | 1.2–7.5 | 0.85 | 0.892 | 60 |
| MnSe + Sb + Sn | Se: 0.028 | Sb: 0.015<br>Sn: 0.020 | 2.6–6.2 | 0.84 | 0.860 | 90 |
| MnSe + Sb + As + Sn | Se: 0.015<br>Sb: 0.020 | As: 0.015<br>Sn: 0.020 | 2.5–9.1 | 0.87 | 0.891 | 60 |
| MnS + Sb + Bi | S: 0.030 | Sb: 0.030<br>B: 0.015 | 1.8–7.7 | 0.86 | 0.902 | 50 |
| MnS + As | S: 0.026 | As: 0.018 | 1.4–6.0 | 0.87 | 0.890 | 70 |
| AlN + MnS | S: 0.020 | Sol.Al: 0.028<br>N: 0.0080 | 5.5–12.6 | 0.86 | 0.951 | 30 |
| AlN + MnSe + Sb | Se: 0.025<br>Sb: 0.050 | Sol.Al: 0.022<br>N: 0.0085 | 5.0–10.2 | 0.88 | 0.940 | 30 |
| AlN + MnS + B | S: 0.022<br>B: 0.00020 | Sol.Al: 0.025<br>N: 0.0085 | 4.8–10.8 | 0.89 | 0.972 | 20 |

Table 1 shows the lowest value and average value of the iron loss obtained with respect to each inhibitor composition and the passing ratio which satisfies the requirement of $W_{17/50}$ of lower than 0.90 W/kg with respect to some step conditions.

It can be seen from these results that the cases where the content of at least one of Se and S is 0.010–0.035% or at least one of Sb, Bi, As and Sn is 0.010–0.080% are superior to the other compositions and the product having a low iron loss can be stably produced.

The production of grain-oriented silicon steel sheets having excellent magnetic properties in the presence of Se or S together with Sb, As, Bi, Sn etc. has been already known by Japanese Patent Application Publication Nos. 76-29,496 and 79-32,412. However, these sheets have the thickness of 0.30 mm or 0.35 mm and the iron loss of these sheets have $W_{17/50}$ of more than 1.0 W/kg. In this case, concerning the amount of Se or S, in many cases, said amount is 0.005–0.1% in single component or combination and concerning Sb, As, Bi, Sn etc., the amount of at least one of these elements is a broad component range of 0.015–0.40%.

While, the present invention is characterized in that $W_{17/50}$ of lower than 0.90 W/kg is obtained by reducing the sheet thickness of the product to be 0.15–0.25 mm and rendering the average grain size to be 1–6 mm and for the purpose, the range of the inhibitors must be limited within the more narrow range than the prior art.

However, the silicon steel sheets having the given property values can not be necessarily obtained only by the component and content of the inhibitors and a variety of considerations are necessary with respect to the conditions for producing the silicon steel sheets. The inventors have attempted various processes and found some effective processes as described hereinafter.

One of them is to control the dispersion of carbon in the steel sheets prior to the final cold rolling. The uniform dispersion of a given amount of solid dissolved carbon or fine carbides prior to cold rolling improves the working structure after cold rolling and makes the primary grain size obtained by the following primary recrystallizing treatment smaller and further forms a large number of Goss nucleuses near the surface layer of the steel sheet. As the result, the secondary grain size after the final annealing becomes 1–6 mm. For the purpose, it is preferable that the carbide is dispersed prior to the cold rolling in such a state that fine carbide of less than 0.5 μm is uniformly dispersed in an average distance of less than 0.5 μm. For attaining this object, it is necessary that carbon is contained in an amount of 0.020–0.060% (this upper limit is defined on the reason that when the amount exceeds 0.060%, the Goss strength at the surface layer is lowered and the magnetic induction of the produced sheet is reduced) and in order to control the dispersion of the carbide in the heat treatment prior to the final cold rolling as described above, after heating at 850°–1,100° C. for more than 0.5 minute, the cooling in the temperature range of 700°–200° C. is effected at a rate of more than 150° C./min. in the cooling course and then a cold rolling is applied in a reduction rate of 55–85%. FIG. 3 shows the relation of the secondary grain size to the cooling rate after the intermediate annealing of the products obtained by the following treatment, with respect to the samples having different carbon contents prior to the secondary cold rolling. A silicon steel hot rolled sheet having a thickness of 2.4 mm and containing 3.10% of Si, 0.025% of Se and 0.030% of Sb was subjected to a primary cold rolling to obtain a sheet having a thickness of 0.6 mm and then subjected to an intermediate annealing at 1,000° C. for 5 minutes and in the succeeding cooling course, several cooling rates in the range of 700°–200° C. are selected and the thus treated sheets are subjected to a secondary cold rolling to the sheet thickness of 0.20 mm and then subjected to decarburizing annealing and finishing annealing at a high temperature. From FIG. 3 it can be seen that the silicon steel sheets satisfying the requirements of the present invention do not deteriorate the magnetic induction and have an average secondary grain size of 1–6 mm.

The second method for making the secondary grain size of the produced thin sheet fine without deteriorating the orientation is to control the rolling temperature in the final cold rolling. That is, in order that the temperature of the steel sheet in the course of cold rolling becomes a range of 50°–400° C., a preheating or an intermediate heating is effected in a temperature range of 50°–400° C. prior to the cold rolling or in the course of cold rolling and the cold rolling is effected at a reduction rate of 55–85% to obtain a sheet thickness of 0.15–0.25 mm. FIG. 4 shows this relation. A hot rolled sheet containing 0.042% of C, 3.30% of Si, 0.025% of Se and 0.040% of Sb is cold rolled to obtain a cold rolled sheet having a thickness of 0.6 mm. The cold rolled sheet is subjected to an intermediate annealing at 1,000° C. for 5 minutes and in the succeeding secondary cold rolling, the sheet is subjected to preheating or intermediate heating at various conditions to obtain three sheets having a thickness of 0.16, 0.20 and 0.24 mm and then subjected to decarburizing annealing and final annealing at a high temperature. The relation of the secondary grain size of the produced sheets to the temperature of the steel sheets during rolling is shown in FIG. 4. FIG. 4 shows that the produced sheets obtained by rolling a range of 50°–400° C. of the steel sheet temperature, which satisfies the requirement of the present invention, have the fine secondary grain size and an iron loss $W_{17/50}$ of lower than 0.90 W/kg. The reason why the secondary grain size is made fine owing to carrying out the rolling at a warm temperature is presumably based on the following fact. Carbon in the steel fixes the dislocation during deformation owing to one kind of strain aging phenomenon which occurs in rolling and prevents the transfer of dislocation, so that the entanglement of dislocation is promoted, whereby the frequency of forming the primary recrystallized nucleus increased and a number of the secondary recrystallized nucleus of Goss grains is increased. Therefore, it is essential that carbon of more than a given amount is contained prior to the final cold rolling and it is more effective for making the secondary crystal grain size fine to combine the means in which the cooling rate after the intermediate annealing prior to the final cold rolling is increased, as a means for increasing an amount of solid dissolved carbon in the steel.

The third method is to control a rate of raising temperature in the decarburizing annealing following to the final cold rolling. It is effective in view of making the secondary grain size fine and improving the iron loss that the steel sheet having a thickness of 0.15–0.25 mm obtained through the final cold rolling under a reduction rate range of 55–85%, is subjected to decarburizing annealing at a temperature raising rate of higher than 100° C./min. in a temperature range of 450°–750° C. in the course of raising temperature to increase the temperature for starting and completing the primary recrystallization. FIG. 5 shows this relation. When a cold rolled sheet having a thickness of 0.18 mm, which has been obtained by effecting the final cold rolling under a reduction rate of 40–90%, is decarburized, such a sheet is subjected to decarburizing annealing by raising temperature from 450° C. to 750° C. at various rates and in wet hydrogen at 820° C. for 5 minutes and then annealed at a high temperature. The relation of the average secondary grain size of the final product to the temperature raising rate in the decarburizing annealing is shown in FIG. 5. It can be seen from FIG. 5 that when the temperature raising rate of a sheet cold rolled at a reduction rate in the final cold rolling of 55–85% is higher than 100° C./min. in the temperature range of 450°–750° C., the silicon steel sheets having an average grain size of 1–6 mm and a low iron loss, which are aimed in the present invention, can be obtained.

The reason why the secondary crystal grain size is made fine by limiting the temperature raising rate in decarburizing annealing as described above, is not clear but a study has been made by comparing the primary recrystallized aggregation structure of the steel sheets subjected to the decarburizing annealing at various temperature raising rates with the secondary grain size of the final product and as the result it has been found that the ratio of <110><001> orientation per <111><112> orientation in the primary recrystallized aggregation structure is increased as the temperature raising rate is higher and the secondary recrystallized necleus of the Goss orientation is increased whereby the secondary grain size of the product becomes fine. Furthermore, it is important that the formation of such primary recrystallized aggregation structure starts at the same time when the decarburization in the steel sheet starts and for the purpose, the temperature raising rate from 450° C. to 750° C. has been particularly defined.

The fourth method is a treatment for forming the secondary recrystallized nucleus, which is carried out after the decarburizing annealing. Anyone of the above mentioned methods has intended to make the secondary grains fine by making the primary recrystallized grains fine and increasing a number of crystal grains of Goss orientation but the fourth method comprises effecting a heat treatment at a temperature of 900°–1,050° C. for a short time of 0.1–15 min. after the decarburizing annealing to make Goss grains on the surface layer to be a size which easily acts as the secondary recrystallized nucleus, that is a size of more than two times of the average crystal grain size. After applying such a nucleus forming treatment, a heat treatment at a temperature range of 800°–900° C. is kept for more than one hour so as to complete the secondary recrystallization, when the final box annealing is carried out, whereby the silicon steel sheets having an average secondary grain size of 1–6 mm can be obtained without deteriorating the magnetic induction of the product. In this case, the limitation of the temperature of the nucleus forming treatment of 900°–1,050° C. is based on the reason that the optimum temperature for the nucleus forming treatment somewhat varies depending upon the kind of inhibitor and the final cold rolling reduction rate. However, when the temperature exceeds the upper limit of 1,050° C., the grains having the inconvenient crystal orientation also become coarse and large and the orientation of the product is deteriorated, so that the upper limit is defined. The limitation of the keeping time of 15 minutes is based on the same reason.

The above described four methods are proposed as the method for making the secondary grain size of the grain-oriented silicon steel sheets having a thin thickness of 0.15–0.25 mm fine without deteriorating the orientation but these methods have the dependent effect respectively but it is effective for more ensuring the effect to combine two or more of these methods without doubling the duplicate portion.

The control of forsterite amount of the steel sheet surface has relation to an atmosphere in the decarburizing annealing, an amount and kind of MgO coated as a separating agent, and an atmosphere in box annealing. The atmosphere in the decarburizing annealing is usually hydrogen or a mixed gas of hydrogen and nitrogen and it is necessary to correctly adjust the mixture ratio and the atmosphere dew point so that the over oxidation does not occur. Among the properties of MgO, an amount of hydrate of MgO influencing upon an amount of oxidation of the steel sheet is particularly important and it is necessary for making an amount of forsterite to be less than 4 g/m$^2$ to use MgO having hydrate amount as low as possible and for example, in the test of hydrate at 20° C. for 30 minutes, it is desirable to use MgO having the hydrate amount of less than 5%. It is most easy to control an amount of forsterite on the surface of the product by an oxidized amount on the surface layer after the decarburizing annealing, an amount of MgO coated and the hydrate amount, so that the atmosphere in the final box annealing at high temperatures is made to be oxidized as low as possible and it is necessary to prevent an additional oxidation in annealing.

An explanation will be made with respect to the reason of limiting the component composition and treating conditions in the present invention.

The silicon steel raw materials applicable to the present invention may be melted according to any prior process but it is necessary to contain 2.0–4.0% of Si. The lower limit of Si is based on the reason that when Si amount is less than 2.0%, the low iron loss, which is the object of the present invention, can not be obtained and the upper limit is based on the reason that when Si amount exceeds the upper limit, the cold rolling ability is deteriorated. The other components are not particularly limited but in addition to nitrides, sulfides and selenides which are known as the inhibitor as mentioned above, if necessary, a necessary amount of grain boundary segregation type elements may be contained. In order to stably obtain the iron loss of $W_{17/50}$ of lower than 0.90 W/kg, it is advantageous to contain 0.010–0.035% in total amount of at least one of Se and S and 0.010–0.080% of at least one of Sb, As, Bi and Sn. A raw material containing the above described components, that is a slab or an ingot is hot rolled according to the well known process (in the case of an ingot, a blooming step is added) to produce a hot rolled sheet having a thickness of 1.5–3.0 mm. In the hot rolling, the slab is heated at a satisfactorily high temperature, for example, higher than 1,200° C. in order to satisfactorily disperse MnSe or MnS or other nitrides contained as the inhibitor. The thickness of the hot rolled sheet is not necessarily determined to a given value depending upon the kind and composition of the inhibitors but for the usually used two step cold rolling process, the thickness is preferred to be 2.0–3.0 mm and in the one step cold rolling process, the thickness of 1.5–2.0 mm is preferable. Thereafter, the hot rolled steel sheet is subjected to one or more cold rollings and if necessary to intermediate annealing at a temperature range of 850°–1,150° C. for 0.5–15 minutes to obtain a cold rolled sheet having a final gauge of 0.5–0.25 mm. In this case, it is particularly preferable in order to adjust the average secondary grain size within a range of 1–6 mm without deteriorating the orientation, that the quenching is effected at a rate of more than 15° C./min. in a temperature range of 700°–200° C. in the course of cooling in the intermediate annealing which is carried out prior to the final cold rolling, that the rolling is effected at a cold rolling reduction rate of 55–85%, that the carbon content is 0.020–0.060% and a preheatng or an intermediate heating is applied prior to the cold rolling or in the course of cold rolling so that the steel sheet temperature upon cold rolling becomes 50°–400° C. The cold rolled sheet having the thickness of 0.15–0.25 mm is then subjected to decarburizing annealing in wet hydrogen at 780°–880° C. for 0.5–15 minutes, whereby carbon content in the steel is reduced to less than 0.005%, but it is preferable for production of the steel sheet having fine secondary grain size and low iron loss to effect a rapid heating at a rate of higher than 100° C./min. from 450° C. to 750° C. in the temperature raising step and a heating for the nucleus forming treatment at a temperature of 900°–1,050° C. for 0.5–15 minutes after the decarburizing annealing. Oxygen potential in the decarburizing atmosphere must be controlled so as not to cause over oxidation, because the oxidized amount after the decarburizing annealing influences upon the forsterite amount of the product. Then, a separating agent, such as MgO is coated and thereafter the coated sheet is subjected to box annealing at high temperatures for secondary recrystallization and purification. The purifying annealing is generally effected in hydrogen at a temperature of higher than 1,100° C. for more than one hour but it is effective for increasing the effect of the present invention that before the purifying annealing, as a treatment for increasing the orientation, a temperature range of 800°–900° C. is maintained for more than 5 hours or a gradual heating is effected at a rate of lower than 15° C./hr. from 800° C. to 900° C., whereby the secondary recrystallization is completed. The box annealed steel sheet is subjected to coating for providing insulation and tension and the thus obtained product has fine secondary grain size and a noticeably low iron loss.

DESCRIPTION OF THE PREFERRED EMBODIMENTS

Example 1

Figure 1:
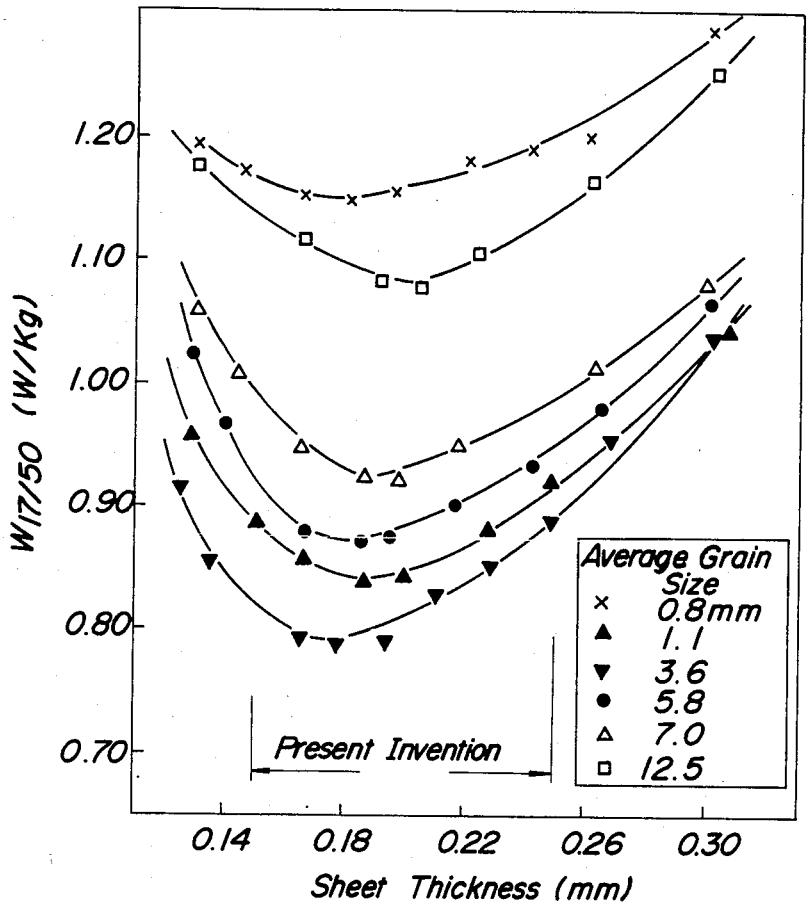
FIG. 1 is a graph showing the relation of the thickness (mm) of the silicon steel sheets having various average secondary grain sizes (mm) to iron loss $W_{17/50}$ (W/kg)
Figure 2:
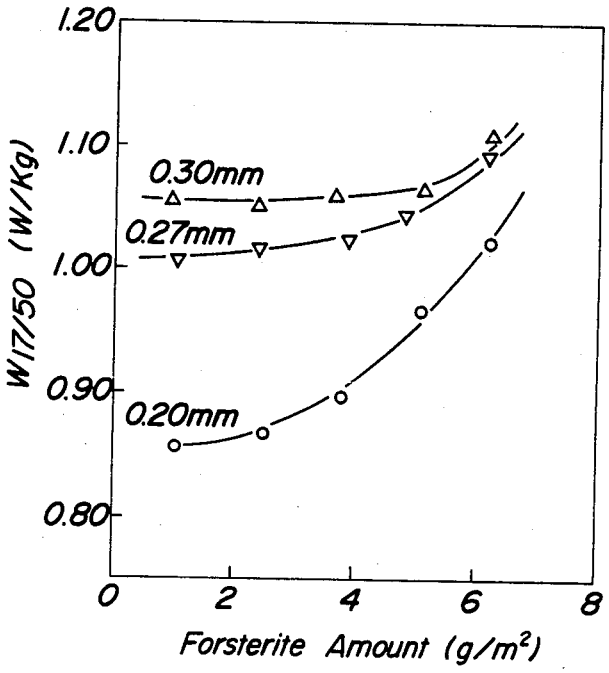
FIG. 2 is a graph showing variation of the relation of the weight (g/m$^2$) of forsterite formed on the silicon steel sheet surface per one surface to the iron loss $W_{17/50}$ (W/kg) due to the sheet thickness.
Figure 3:
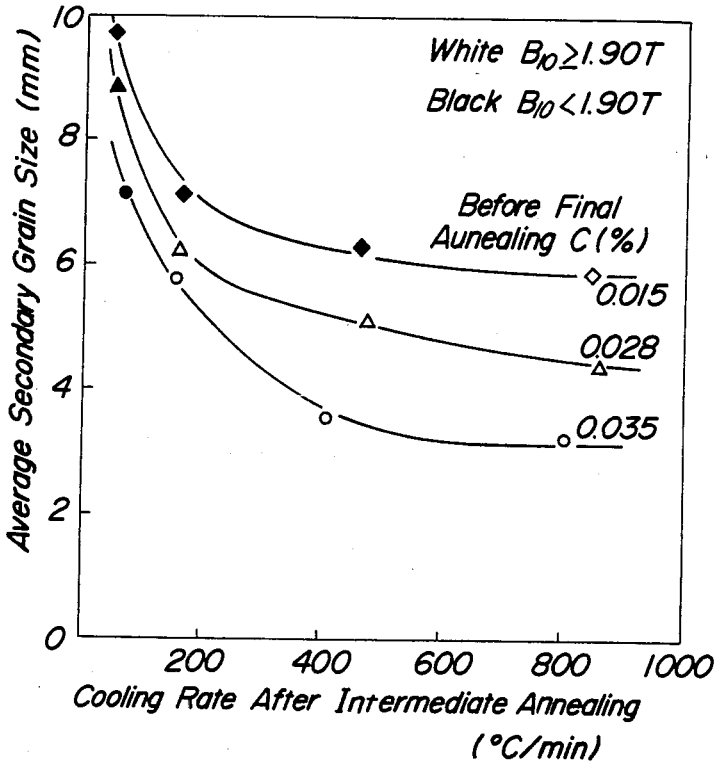
FIG. 3 is a graph showing the relation of the cooling rate (°C./min) from 700° C. to 200° C. in the course of cooling after the annealing which is carried out prior to the final cold rolling to the average secondary grain size (mm) of the product with respect to the samples having various carbon contents (%) prior to the final cold rolling.
Figure 4:
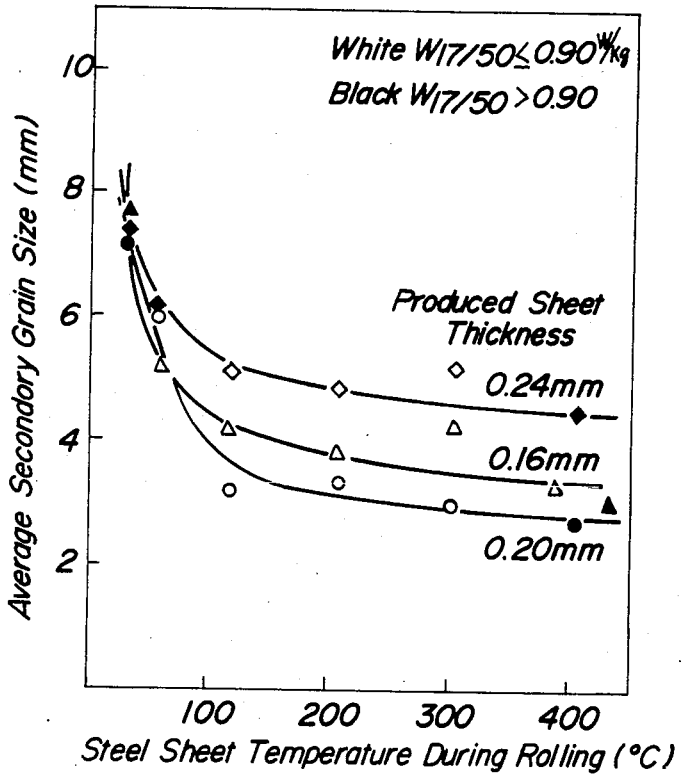
FIG. 4 is a graph showing the relation of the temperature of steel sheets having varied thickness during rolling in the final cold rolling to the average secondary grain size.
Figure 5:
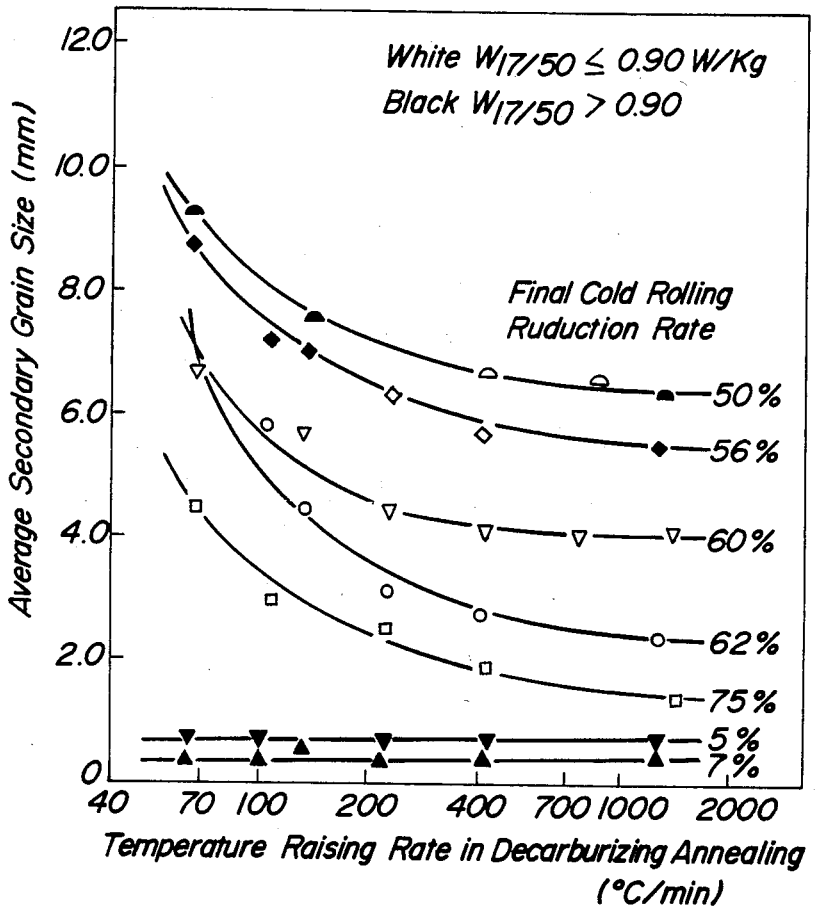
FIG. 5 is a graph showing the relation of the temperature raising rate (°C./min) in a temperature range of 450°–750° C. in the course of raising temperature in the decarburizing annealing to the average crystal grain size with respect to various final cold reduction rates (%).

Silicon steel slab consisting of 0.050% of C, 3.01% of Si, 0.078% of Mn, 0.025%of S, 0.035% of Sb and the balance being Fe was heated at 1,340° C. for 3 hours and hot rolled to obtain a hot rolled sheet having a thickness of 2.4 mm. The hot rolled sheet was heated at 950° C. for 5 minutes and then cold rolled to obtain an intermediate thickness of 0.6 mm and again subjected to an intermeidate annealing at 950° C. for 5 minutes and then secondarily cold rolled at a reduction rate of 50–83% to obtain a sheet having a thickness of 0.1–0.30 mm. The decarburizing annealing was carried out in a mixed atmosphere of wet hydrogen and nitrogen at 800° C. for 5 minutes and the sheet was coated with MgO as a separating agent and box-annealed in hydrogen at 1,200° C. for 5 hours. Concerning a cold rolled sheet having a thickness of 0.2 mm, in order to check the influence of the forsterite amount of the product, the decarburizing annealing was effected at a dew point of 60° C. by varying nitrogen compounding ratio from 20% to 40%. The magnetic properties and the secondary grain size of the product and the forsterite amount per one surface on the sheet surface are shown in the following Table 2.

TABLE 2

| Sheet thickness (mm) | Average secondary grain size (mm) | Forsterite amount (g/m$^2$) | $W_{17/50}$(w/kg) | $B_{10}$ (T) | |
|---|---|---|---|---|---|
| 0.10 | 0.8 | 3.2 | 1.32 | 1.80 | |
| 0.16 | 5.6 | 2.8 | 0.88 | 1.91 | Present invention |
| 0.20 | 4.8 | 1.8 | 0.83 | 1.92 | Present invention |
| 0.20 | 4.8 | 3.0 | 0.86 | 1.91 | Present invention |
| 0.20 | 4.7 | 5.8 | 0.95 | 1.90 | |
| 0.24 | 5.2 | 3.3 | 0.87 | 1.91 | Present invention |
| 0.27 | 7.4 | 3.2 | 0.99 | 1.91 | |
| 0.30 | 8.2 | 3.4 | 1.07 | 1.91 | |

Example 2

A hot rolled sheet having a thickness of 2.5 mm and containing 0.041% of C, 3.08% of Si, 0.080% of Mn, 0.025% of Se and 0.031% of Sb was heated at 950° C. for 5 minutes and then subjected to primary cold rolling at a reduction rate of 70% to obtain an intermediate thickness of 0.75 mm and the thus obtained sheet was subjected to intermediate annealing in Ar gas at 1,000° C. for 5 minutes. After the intermediate annealing the cooling in a temperature range of 700°–200° C. was carried out under two conditions, that is, at 120° C./min. and 400° C./min. Thereafter, the sheet was subjected to cold rolling to obtain a final gauge of 0.20 mm but in this rolling, the sheet was separately treated under the following three conditions. That is, in the first case, upon the rolling, the sheet was preheated at 300° C. for 3 hours. In the second case, the sheet was preheated at 300° C. for 3 hours and then in the course of cold rolling, that is when the sheet thickness was 0.40 mm, the sheet was again heated at 300° C. for 1 hour. In the third case, the cold rolling was effected without carrying out the preheating and the intermediate heating. The cold rolled sheet was decarburized in wet hydrogen at 800° C. for 5 minutes and coated with MgO and then subjected to final annealing in hydrogen at 1,200° C. for 5 hours. The magnetic properties and the secondary grain size of the obtained sheets are shown in the following Table 3.

TABLE 3

| Cooling after intermediate annealing (°C./min) | Preheating or intermediate heating in cold rolling | Average secondary grain size (mm) | $W_{17/50}$ (w/kg) | $B_{10}$ (T) |
|---|---|---|---|---|
| 120 | Non | 6.8 | 0.92 | 1.91 |
| 120 | Preheating | 5.9 | 0.90 | 1.91 |
| 400 | Non | 4.8 | 0.87 | 1.92 |
| 400 | Preheating | 3.5 | 0.84 | 1.91 |
| 400 | Preheating + intermediate heating | 2.1 | 0.85 | 1.90 |

Example 3

A silicon steel slab containing 0.042% of C, 3.28% of Si, 0.068% of Mn, 0.022% of Se, 0.035% of Sb, 0.020% of Sn, 0.010% of As and the balance being Fe was heated at 1,340° C. for 3 hours and then hot rolled to obtain a hot rolled sheet having a thickness of 2.2 mm. Then, the thus treated sheet was heated at 950° C. for 5 minutes and then cold rolled at a reduction rate of 75% to obtain an intermediate thickness of 0.55 mm, which was again annealed at 950° C. for 5 minutes and then secondarily cold rolled at a reduction rate of 64% to obtain a sheet having a thickness of 0.20 mm. Thereafter, when the decarburizing annealing was effected in hydrogen at 800° C. for 5 minutes, the temperature was raised from 450° C. to 750° C. under four conditions of 70° C./min., 150° C./min., 300° C./min. and 600° C./min. A part of samples, after decarburization, was subjected to secondary recrystallized nucleus forming treatment at 950° C. for 5 minutes. Then, the sheet was coated with MgO as a separating agent and then subjected to secondary recrystallizing annealing in Ar gas at 860° C. for 24 hours and successively to purifying annealing in hydrogen at 1,200° C. for 5 hours to obtain the final product. The magnetic properties and average secondary grain size of the obtained silicon steel sheets are shown in the following Table 4.

TABLE 4

| Temperature raising rate in decarburizing annealing (°C./min) | Secondary recrystallized nucleus forming treatment | Average secondary grain size (mm) | $W_{17/50}$ (w/kg) | $B_{10}$ (T) |
|---|---|---|---|---|
| 70 | Non | 7.6 | 0.91 | 1.91 |
| 150 | Non | 5.2 | 0.88 | 1.92 |
| 300 | Non | 3.8 | 0.86 | 1.92 |
| 300 | " | 3.2 | 0.84 | 1.92 |
| 600 | Non | 3.5 | 0.84 | 1.92 |
| 600 | " | 3.0 | 0.83 | 1.91 |

What is claimed is:

1. Grain oriented silicon steel sheets having a very low iron loss $W_{17/50}$ of lower than 0.90 W/kg, in which Si content is 2–4%, the sheet thickness is 0.15–0.25 mm, an average crystal grain size is 1–6 mm and forsterite coating per one surface on the steel sheet surfaces is 1–4 g/m$^2$.

2. In a method for producing grain-oriented silicon steel sheets having a very low iron loss, which method includes subjecting a hot-rolled steel sheet to one cold rolling or two or more cold rollings between which an intermediate annealing is effected, to obtain a final gauge and then subjecting the cold-rolled steel sheet to decarburizing annealing and coating the sheet with an annealing separator, and then subjecting the coated sheet to final annealing, the improvement comprising subjecting the hot-rolled steel sheet which contains 2–4% of Si, 0.010–0.035% of at least one of Se and S, and 0.010–0.080% of at least one of Sb, As, Bi and Sn as inhibitor, to the cold rolling, heating the cold-rolled steel sheet at a temperature of 850°–1,100° C. for at least 0.5 minute, cooling the heated steel sheet at a cooling rate of higher than 150° C./min in a temperature range of 700°–200° C., to adjust the carbon content of the steel sheet from 0.020 to 0.060% prior to a final cold rolling, effecting a final cold rolling of the steel sheet at a reduction rate of 55–85% to obtain a final thickness gauge of 0.15–0.25 mm for the steel sheet, and coating an annealing separator on the steel sheet surface so as to form 1–4 g/m$^2$ per one surface of forsterite film during final annealing, whereby 1–6 mm of secondary recrystallized grain size is obtained.

3. In a method for producing grain-oriented silicon steel sheets having a very low iron loss, which method includes subjecting a hot-rolled steel sheet to one cold rolling or two or more cold rollings between which an intermediate annealing is effected, to obtain a final gauge and then subjecting the cold-rolled steel sheet to decarburizing annealing and coating the sheet with an annealing separator and then subjecting the coated sheet to final annealing, the improvement comprising, after intermediate annealing, subjecting the steel sheet, which contains 0.020–0.060% of C, 2–4% of Si, 0.010–0.035% of at least one of Se and S and 0.010–0.080% of at least one of Sb, As, Bi and Sn as inhibitor, to a final cold rolling at a reduction rate of 55–85% while adjusting a temperature of the steel sheet at 50°–400° C. to obtain a final thickness gauge of 0.15–0.25 mm and coating an annealing separator on the steel sheet surface to form 1–4 g/m$^2$ per one surface of forsterite film, whereby 1–6 mm of secondary recrystallized grain size is obtained.

4. In a method for producing grain-oriented silicon steel sheets having a very low iron loss, which method includes subjecting a hot-rolled steel sheet to one cold rolling or two or more cold rollings between which an intermediate annealing is effected, to obtain a final gauge and then subjecting the cold-rolled sheet to decarburizing annealing and coating the steel sheet with an annealing separator and then subjecting the coated sheet to final annealing, the improvement comprising, after intermediate annealing, subjecting the steel sheet, which contains 2–4% of Si, 0.010–0.035% of at least one of Se and S and 0.010–0.080% of at least one of Sb, As, Bi and Sn as inhibitor, to a final cold rolling at a reduction rate of 55–85% to obtain a final thickness gauge of 0.15–0.25 mm, subjecting the cold-rolled steel sheet to a decarburizing annealing at a temperature raising rate of higher than 100° C./min. in a temperature range of 450°–750° C. and keeping the steel sheet in wet hydrogen in a temperature range of 780°–880° C. for 1–15 minutes, and coating an annealing separator on the steel sheet surface to form 1–4 g/m$^2$ per one surface of forsterite film, whereby 1–6 mm of secondary recrystallized grain size is obtained.

5. In a method for producing of grain-oriented silicon steel sheets having a very low iron loss, which method includes subjecting a hot-rolled steel sheet to one cold rolling or two or more rollings between which an intermediate annealing is effected to obtain a final gauge, and then subjecting the cold-rolled sheet to decarburizing annealing and coating the sheet with an annealing separator, and then subjecting the coated sheet to final annealing, the improvement comprising subjecting the cold-rolled steel sheet having a final thickness gauge of 0.15–0.25 mm, which contains 2–4% of Si and 0.010–0.035% of at least one of Se and S, and 0.010–0.080% of at least one Sb, As, Bi and Sn as inhibitor, to decarburizing annealing, heating the decarburized steel sheet at a temperature of 900°–1,050° C. for 0.1–15 min., coating an annealing separator on the steel sheet surface, and then subjecting the coated steel sheet to a box annealing at a temperature range of 800°–900° C. for more than one hour, whereby 1–4 g/m$^2$ per one surface of forsterite film is formed during annealing and 1–6 mm of secondary recrystallized grain size is obtained.

6. The improved method according to claim 2, further comprising effecting the final cold rolling of the steel sheet at a reduction rate of 55–85% while adjusting the temperature of the steel sheet at 50°–400° C. to obtain a final thickness gauge of 0.15–0.25 mm for the steel sheet, whereby 1–6 mm of secondary recrystallized grain size is obtained.

7. The improved method according to claim 2, further comprising subjecting the cold-rolled steel sheet to a decarburizing annealing at a temperature raising rate of higher than 100° C./min. in a temperature range of 450°–750° C. and keeping the steel sheet in wet hydrogen in a temperature range of 780°–880° C. for 1–15 minutes, whereby 1–6 mm of secondary recrystallized grain size is obtained.

8. The improved method according to claim 5, further comprising, prior to a final cold rolling, heating the cold-rolled steel sheet at a temperature range of 850°–1100° C. for at least 0.5 minute, cooling the heated steel sheet at a cooling rate of higher than 150° C./min. in a temperature range of 700°–200° C. to adjust the carbon content of the steel sheet from 0.020 to 0.060%, whereby 1–6 mm of secondary recrystallized grain size is obtained.

9. The improved method according to claim 3, further comprising subjecting the cold-rolled steel sheet to a decarburizing annealing at a temperature raising rate of higher than 100° C./min., in a temperature range of 450°–750° C., and keeping the steel sheet in wet hydrogen in a temperature range of 780°–880° C. for 1–15 minutes, whereby 1–6 mm of secondary recrystallized grain size is obtained.

* * * * *